US005769018A

United States Patent [19]

Nakano

[11] Patent Number: 5,769,018

[45] Date of Patent: Jun. 23, 1998

[54] LOOPER THREAD CONTROL METHOD AND DEVICE FOR A DOUBLE CHAINSTITCH SEWING MACHINE

[75] Inventor: Minoru Nakano, Osaka, Japan

[73] Assignee: Pegasus Sewing Machine Mfg. Co., Ltd., Osaka, Japan

[21] Appl. No.: 628,547

[22] Filed: Apr. 10, 1996

[30] Foreign Application Priority Data

Apr. 12, 1995 [JP] Japan ..... 7-112501

[51] Int. Cl.[6] ..... D05B 61/00

[52] U.S. Cl. ..... 112/475.17; 112/200

[58] Field of Search ..... 112/475.17, 165, 112/197, 199, 187, 200

[56] References Cited

U.S. PATENT DOCUMENTS

| | | | |
|---|---|---|---|
| 1,619,436 | 3/1927 | Rubel et al. | 112/165 X |
| 3,068,818 | 12/1962 | Schoij et al. | 112/200 |
| 3,753,410 | 8/1973 | Kostenowczyk | 112/199 |
| 3,903,821 | 9/1975 | Marforio | 112/242 |
| 4,325,314 | 4/1982 | Niem | 112/199 |
| 4,480,562 | 11/1984 | von Hagen et al. | 112/200 |
| 4,974,534 | 12/1990 | Eberhahn et al. | 112/199 |

*Primary Examiner*—Ismael Izaguirre

*Attorney, Agent, or Firm*—Flynn, Thiel, Boutell & Tanis, P.C.

[57] ABSTRACT

In a looper thread control device for a double chainstitch sewing machine, the sewing needles are lowered securely into a thread triangle, even under the conditions of low thread tension and high speed operation, and with an elastic looper thread, without rib formation or skipped stitches in the fabric. A looper thread support member 1 moves up and down in cooperation with sewing needles NL, NR near the left end of the looper L. The looper thread support member 1 enters into the triangle prior to the descent of the sewing needles, and seizes the looper thread LT. The looper thread support member 1 holds the looper thread until the eyelet LE on the looper moves to the right side of the looper thread support member 1, thereby pulling out the looper thread LT from the thread source, and then releases the looper thread.

6 Claims, 2 Drawing Sheets

LOOPER THREAD CONTROL METHOD AND DEVICE FOR A DOUBLE CHAINSTITCH SEWING MACHINE

BACKGROUND OF THE INVENTION

The present invention relates to a looper thread control method and device for a double chainstitch sewing machine.

In a multi-needle double chainstitch sewing machine for forming stitches of stitch type numbers such as 406, 602, 407, 605, and others specified in JIS (Japanese Industrial Standards) L0120 or United States Federal Standards No. 751a, stitches are formed in the following fashion.

First, rising needles which hold a needle thread in an eyelet of them each make a needle thread loop with the needle thread. Secondly, a looper, which holds a looper thread passing through an eyelet on the front end of the looper, enters the needle thread loops. The looper then moves to the front side, and the needle descends into a triangle formed by the needle threads, blade of the looper, and looper thread, while the looper returns to the right, and thereafter these steps are repeated.

The looper thread control devices used for feeding the looper thread and controlling the tension in these steps are shown, for example, in Japanese Patent 55-25879 (JP, B2) (corresponding to U.S. Pat. No. 3,903,821) and Japanese Patent 61-60716 (JP, B2) (corresponding to U.S. Pat. No. 4,325,314). These devices have rotary cam plates and a slit plate in the bed of the sewing machine and are designed to project and retract the cam plates rotating in cooperation with the main shaft of the sewing machine through the slit plate, slide the looper thread guided by guide members provided at both sides of the slit plate on the outer circumference of the cam plates, and control the thread reserve amount between the tension regulator and looper by the projecting extent of the cam outer circumference from the slit plate. This cam plate keeps the looper thread in a loose state for forming a stitch when the looper moves from right to left behind the needle in order to get into the needle thread loop, and absorbs the looseness of the looper thread, and also pulls out the looper thread from the thread source to be ready for forming a next stitch when the looper moves before the needle and returns to the right while lowering the needle into the triangle formed by the needle thread, blade of the looper, and looper thread.

Even if such a looper thread control device is used, the looper thread must be kept at a lower tension generally as compared with the needle thread and, for example, in a two-needle double chainstitch sewing machine having right and left needles arranged at the lower end of the needle bar, when sewing a thin cloth by using sewing threads composed of elastic yarns such as textured yarn, unless controlled to an extremely low tension, the cloth between the two needles gathers due to thread amount shortage, and a rib like a dome roof is likely to form. Or, when the tension of the looper thread is very low or when operating the sewing machine at high speed, the looper thread may oscillate back and forth, and when the looper goes back to the right, the needle may not fall into the triangle and a skipped stitch may result.

To put the needles securely into the triangle, generally, the needles are lowered while keeping contact with the back side of the blade of the looper, and therefore the needle surfaces are likely to be scratched, which may cause damage to material yarns of fabric. Japanese Patent 2-37196 (JP, B2) (corresponding to U.S. Pat. No. 4,480,562) discloses a spreader for seizing the looper thread and extending the triangle before the needles descend in order to put the needles securely into the triangle. However, to avoid collision of the spreader and looper, right after the needles descend, the spreader is moved back to release the engagement of the spreader and looper thread, and nothing is disclosed about control of the looper thread after that.

Moreover, the cam shaft of this thread control device rotates in one direction and if the looper thread is cut and entangled around the cam shaft, it is very difficult to remove it.

In light of the problems of such a conventional sewing stitch forming mechanism and looper thread control device for its purpose, it is an object of the invention to prevent the formation of a rib or occurrence of a skipped stitch by lowering the needle securely into the triangle, even at a low tension, to lower the needle easily into the triangle without it contacting with the needle, and to eliminate the risk of thread entanglement.

SUMMARY OF THE INVENTION

The invention relates to a double chainstitch sewing machine which seizes the looper thread which forms the thread triangle with the needle threads and looper blade, by the looper thread support member at the left side of the sewing machine needle between the eyelet of the looper and the needle thread loop prior to the lowering of the sewing machine needles into the triangle. This seizure is maintained until the eyelet of the looper is moved to the right side of the seizing position of the looper thread by the looper thread support member. Along with the rightward move of the looper, the triangle deforms and extends, and the looper thread is pulled out from the thread source and, after a specified time, this seizure is released. In the device of the invention, the looper thread support member oscillating in cooperation with the vertical motion of the sewing machine needles may be installed near the left end position of the eyelet of the looper.

This seizure may be released by moving the looper thread support member, but a seizure releasing member may also be provided as a separate member from the looper thread support member. In these devices, the looper thread support member may seize and support the looper thread by a mechanically oscillating hook member, gripping member, air suction or the like, and it can be released by the ejection of air or the like.

In this invention, when forming a double chainstitch, the looper thread support member deforms and extends the triangle and, therefore, if the sewing machine is operated at a high speed, the sewing machine needle can easily enter into the triangle, and it is not necessary to keep the sewing machine needle in contact with the back side of the blade of the looper. After the looper thread support member has seized the looper thread, this seizure is maintained until the looper moves to the right and the eyelet of the looper is moved to the right side of the seizing position by the looper thread support member and, therefore, by this seizure, the looper thread extending from the seizing point to the stitch and to the looper eyelet forms an acute angle and a sufficient length of thread is pulled out from the thread source side depending on the seizure duration time. After the seizure is released, the withdrawn looper thread is pulled up to the lower side of the fabric and makes a stitch with the needle threads, so that a rib due to the shrinkage of the looper thread will not form in the fabric between the needles when using a looper thread consisting of textured yarn in two-needle or three-needle sewing machines. The seizure releasing member may enhance the precision of the control of the thread pull-out amount. By using the looper thread support member of the invention, the rotary cam for looper thread control may be omitted.

Other objects and new features of the invention may be better understood by the embodiments described below. It must be noted, however, that the embodiments are presented as mere examples and are not intended to limit the scope of the invention.

DESCRIPTION OF THE PREFERRED EMBODIMENTS

Figure 1:
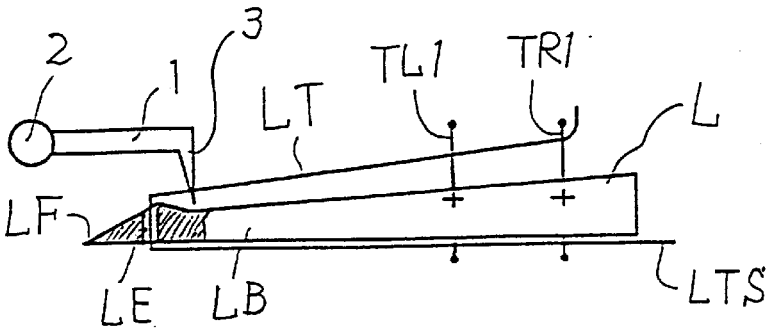
FIG. 1 is a partially cut-away plan view illustrating the operation of a sewing machine according to a first embodiment of the invention.

The drawings show only the stitch forming section in the bed of a double chainstitch sewing machine, and other parts are the same as in conventional double chainstitch sewing machines and are not shown in the drawings. In this sewing machine, left and right needles NL, NR move vertically and penetrate through the needle holes of the throat plate on the bed, and one looper L making elliptical motions back and forth and right and left, intersects with the moving direction of the needles in the bed to form a stitch shown by stitch type number 406 by two needle threads TL1, TR1 passing through individual eyelets of the needles NL, NR, and a looper thread LT passing through an eyelet LE on the looper L. In the bed, a looper thread support member 1 is provided on a shaft 2 oscillating in cooperation with the vertical motion of the sewing needles NL, NR and the front end 3 of the looper thread support member moves vertically between the left side of the left needle NL and the top end LF of the looper L at the left dead center of it. The looper thread support member 1 is made of a metal bar having its front end 3 bent downward, and when moving downward, the front end 3 seizes the looper thread LT and, when moving up, it is released.

In a first embodiment, it is released by the motion of the looper thread support member 1 without using a releasing member.

In this device, the angle of rotation of the main shaft of the sewing machine is defined to be 0 degree when the needles are at their highest center position, and 180 degrees when they are at their lowest center position, and the action of the device is described below.

As the needles NL, NR begin to descend from their highest center position (0 degree), when the looper L moves to the right and before the needles nearly come to 80 degrees, the front end 3 of the looper thread support member 1 enters into a triangle formed by the needle threads TL1, TR1 and looper thread LT, which is bent at the eyelet LE along the looper blade LB, and seize and holds the looper thread LT (FIG. 1). Maintaining this holding state, successively, when the looper L moves to the right elliptically in front of and to the right of the needles NL, NR, the triangle deforms and becomes an extended loop and the looper thread LT is gradually bent by the portion seized by the front end 3 of the looper thread support member 1. Around 90 degrees, the left needle NL and right needle NR enter into the deformed loop sequentially (FIG. 2).

Figure 2:
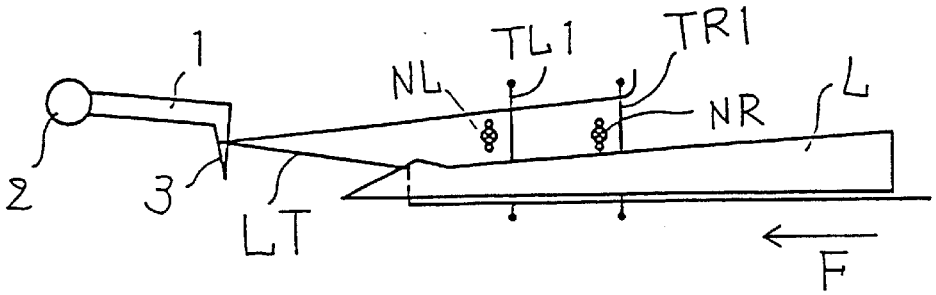
FIGS. 2 to 6 are plan views showing operational steps of the sewing machine according to the first embodiment of the invention.
Figure 3:
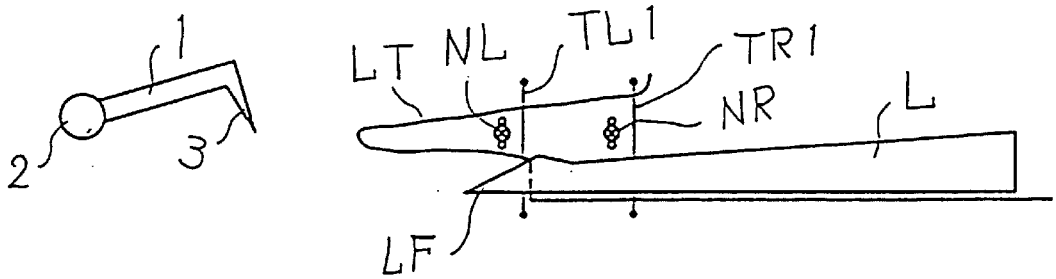

Consequently, when the looper L moves to the right, the looper thread LT is pulled out from the thread source side shown by an arrow F in FIG. 2 as the bent part is formed into an acute angle by the front end 3 between looper eyelet LE and the previously formed stitch, and hence the thread is maintained at a length about twice the distance between the eyelet LE of the looper and the position held by the front end 3. After 95 degrees, preferably after reaching around 100 degrees, the looper thread support member 1 is raised, and the looper thread LT is released from the front end 3 (FIG. 3), and when the needle thread loops slip out from the front end LF of the looper L around 120 to 130 degrees, the length of the looper thread LT is pulled up to the lower side of the fabric by the needle thread loops TL1, TR1 (FIG. 4), so that the stitch is formed without causing a shortage of thread amount. Therefore, if the looper thread is elastic, the fabric between the needles will not be pulled in, so that the formation of a dome-shaped rib may be prevented.

Figure 4:
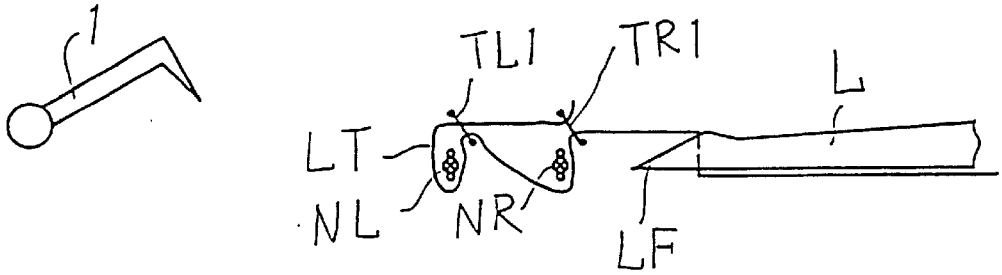
Figure 5:
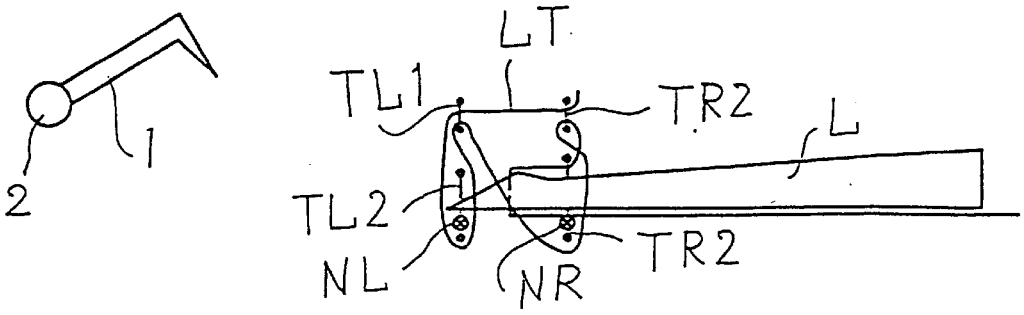
Figure 6:
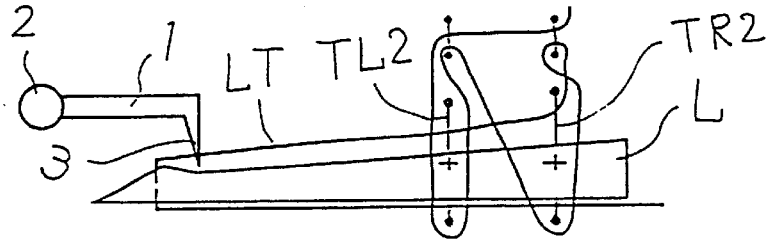

FIG. 5 shows the state of the looper L moving left behind the needles NL, NR to get into the next needle thread loops TL2, TR2, in order to form the next stitch successively to FIG. 4. FIG. 6 shows the front end 3 of the looper thread support member 1 descending into the triangle, prior to the descent of the needles into the triangle, near the left dead center of the looper L, thereby seizing the looper thread LT.

The thread amount is adjusted by varying the timing of seizing and releasing depending on the kind of thread, distance between needles and other factors, but it is also possible by changing the vertical or lateral position of seizing, or changing the oscillating mechanism of looper thread support member 1 such as raising or descending extent of the front end 3 of the looper thread support member and degree of seizing.

This embodiment shows the looper thread support member mechanical structure, but aside from the mechanical type, air ejection and suction types may be employed, or the looper thread support member itself may be furnished with a mechanical or pneumatic releasing member.

Figure 7:
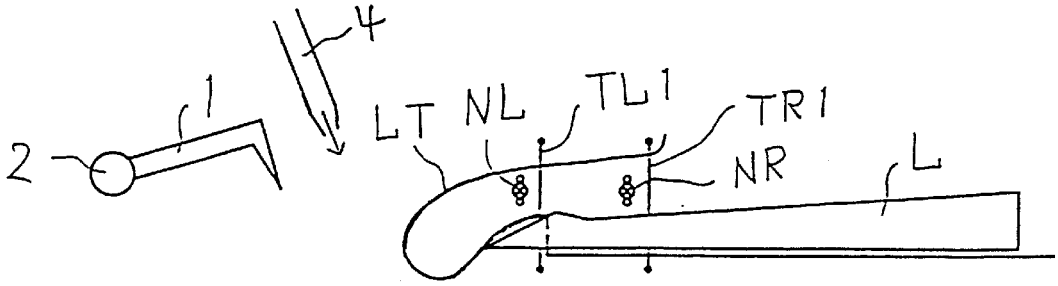
FIG. 7 is a plan view showing an operational step of a sewing machine according to a second embodiment of the invention.

In a second embodiment shown in FIG. 7, an air ejection tube 4 is provided near the front and of the looper thread support member 1 as a device for releasing by force the engagement of the looper thread support member 1 and looper thread LT. This air ejection tube 4 acts in cooperation with the motion of the needles NL, NR, and pushes down the looper thread LT seized by the looper thread support member 1 according to a preset timing.

What is claimed is:

1. A method of forming a double chainstitch with a sewing machine, said sewing machine comprising a pair of needles having threads passing through eyelets provided therein and mounted for vertical movement, a looper having a looper thread passing through an eyelet provided therein and mounted for lateral elliptical movement and a looper thread support member having an end thereof adapted to move toward and grasp the looper thread and move away and release the looper thread, said method comprising the steps of:

lowering the pair of needles from their highest position;

moving the end of the looper thread support member into an area defined by the needle threads and the looper thread;

grasping the looper thread with the end of the looper thread support member at a position that is to the left of the pair of needles and above and at the left center of the looper;

moving the looper to the right and in front of the descending pair of needles and deforming the area defined by the needle threads and the looper thread to form a loop;

lowering the pair of needles into the loop;

moving the end of the looper thread support member away from the loop to disengage the looper thread therefrom;

raising the pair of needles from their lowermost position; and moving the looper to the left and behind the rising pair of needles to begin formation of a new stitch.

2. The method of claim 1, wherein the disengagement of the looper thread support member from the looper thread is after 95 degrees, based on the angle of rotation of a main shaft of a sewing machine being 0 degrees when the needles are at their highest position and 90 degrees when the needle enters into the loop formed by the needle threads and the looper thread.

3. A sewing machine and looper thread control device for forming a double chainstitch comprising: a pair of needles having threads passing through eyelets provided therein and mounted for vertical movement; means for imparting a vertical movement to said pair of needles; a looper having a looper thread passing through an eyelet provided therein and mounted for lateral elliptical movement to the left and behind the needles and to the right and in front of the needles; means for imparting said lateral elliptical movement to said looper; a looper thread support member mounted for movement towards said looper thread and away from said looper thread, said looper thread support member having an end thereof comprising means for grasping said looper thread at a position that is to the left of the pair of needles and above and at the left center of the looper; and means for moving the looper thread support member towards the looper thread to grasp it and away from the looper thread to release it.

4. The sewing machine and looper thread control device of claim 3, additionally comprising a looper thread releasing member provided adjacent the looper thread support member for aiding in the release of the looper thread from the end of the looper thread support member.

5. A method of forming a double chainstitch with a sewing machine, said sewing machine comprising a pair of needles having threads passing through eyelets provided therein and mounted for vertical movement, a looper having a looper thread passing through an eyelet provided therein and mounted for lateral elliptical movement and a looper thread support member having an end thereof adapted to move toward and grasp the looper thread and move away and release the looper thread, said method comprising the steps of:

lowering the pair of needles from their highest position;

moving the end of the looper thread support member vertically in cooperation with the vertical movement of the needles into an area defined by the needle threads and the looper thread;

grasping the looper thread with the end of the looper thread support member;

moving the looper to the right and in front of the descending pair of needles and deforming the area defined by the needle threads and the looper thread to form a loop;

lowering the pair of needles into the loop;

moving the end of the looper thread support member away from the loop to disengage the looper thread therefrom;

raising the pair of needles from their lowermost position; and moving the looper to the left and behind the rising pair of needles to begin formation of a new stitch.

6. A sewing machine and looper thread control device for forming a double chainstitch comprising: a pair of needles having threads passing through eyelets provided therein and mounted for vertical movement; means for imparting a vertical movement to said pair of needles; a looper having a looper thread passing through an eyelet provided therein and mounted for lateral elliptical movement to the left and behind the needles and to the right and in front of the needles; means for imparting said lateral elliptical movement to said looper; a looper thread support member mounted for movement towards said looper thread and away from said looper thread, said looper thread support member having an end thereof comprising means for grasping said looper thread; means for moving the end of the looper thread support member vertically in cooperation with the vertical movement of the needles; and means for moving the looper thread support member towards the looper thread to grasp it and away from the looper thread to release it.

* * * * *